US008904708B2

(12) United States Patent
Zacchio et al.

(10) Patent No.: US 8,904,708 B2
(45) Date of Patent: Dec. 9, 2014

(54) DOOR ZONE PROTECTION

(75) Inventors: Joseph Zacchio, Wethersfield, CT (US); Bryan Siewert, Westbrook, CT (US)

(73) Assignee: Otis Elevator Company, Farmington, CT (US)

( * ) Notice: Subject to any disclaimer, the term of this patent is extended or adjusted under 35 U.S.C. 154(b) by 199 days.

(21) Appl. No.: 12/991,481

(22) PCT Filed: May 21, 2008

(86) PCT No.: PCT/US2008/006486

§ 371 (c)(1),
(2), (4) Date: Nov. 8, 2010

(87) PCT Pub. No.: WO2009/142610

PCT Pub. Date: Nov. 26, 2009

(65) Prior Publication Data

US 2011/0056134 A1 Mar. 10, 2011

(51) Int. Cl.
*E05F 15/20* (2006.01)

(52) U.S. Cl.
USPC ..... 49/25

(58) Field of Classification Search
USPC ..... 49/25, 26, 28
See application file for complete search history.

(56) References Cited

U.S. PATENT DOCUMENTS 3,742,434 A * 6/1973 Leyde et al. ..... 49/25
3,852,592 A * 12/1974 Scoville et al. ..... 250/221
4,029,176 A * 6/1977 Mills ..... 187/317
4,490,716 A * 12/1984 Tsuda et al. ..... 340/904
4,524,356 A * 6/1985 Kodera et al. ..... 340/904
4,551,722 A * 11/1985 Tsuda et al. ..... 340/904
4,561,064 A * 12/1985 Bruggen et al. ..... 702/159
4,606,015 A * 8/1986 Yamaguchi ..... 367/95
4,851,746 A * 7/1989 Milke ..... 318/467
4,858,203 A * 8/1989 Hansen ..... 367/103
4,905,207 A * 2/1990 Fellinger et al. ..... 367/99
4,967,083 A * 10/1990 Kornbrekke et al. ..... 250/341.7
5,001,557 A * 3/1991 Begle ..... 348/166

(Continued)

FOREIGN PATENT DOCUMENTS

DE 10234291 A1 5/2004
EP 0552338 B1 7/1993

(Continued)

OTHER PUBLICATIONS

Korean Office Action, mailed Jul. 23, 2012.

(Continued)

*Primary Examiner* — Jerry Redman
(74) *Attorney, Agent, or Firm* — Cantor Colburn LLP

(57) ABSTRACT

An apparatus for detecting an object 20 in an area adjacent a doorway includes a plurality of transducers $US_1$, $US_2$ mounted proximate the doorway and a processor 40. At least one of the transducers $US_1$ is positioned to repeatedly transmit signals $T_1$ toward an area adjacent the doorway. At least two of the transducers $US_1$, $US_2$ are positioned to repeatedly receive $R_1$, $R_2$ return signals. The processor 40 is operably connected to the plurality of transducers for detecting, in the area adjacent the doorway, an object 20 by determining the object's: position based upon one or more determined distances $d_1$, $d_2$ derived from times between transmission of signals and reception of corresponding return signals; and/or movement based upon transmission of signals and Doppler shift in the reception of corresponding return signals.

22 Claims, 3 Drawing Sheets

(56) References Cited

U.S. PATENT DOCUMENTS

| | | | | |
|---|---|---|---|---|
| 5,142,152 | A * | 8/1992 | Boiucaner | 250/341.7 |
| 5,159,837 | A * | 11/1992 | Wada | 73/602 |
| 5,160,927 | A * | 11/1992 | Cherry et al. | 340/904 |
| 5,177,711 | A * | 1/1993 | Yamaguchi et al. | 367/105 |
| 5,329,075 | A | 7/1994 | Hirabayashi et al. | |
| 5,583,405 | A * | 12/1996 | Sai et al. | 318/286 |
| 5,627,439 | A * | 5/1997 | Gregory et al. | 318/480 |
| 5,789,739 | A * | 8/1998 | Schwarz | 250/221 |
| 5,805,527 | A * | 9/1998 | Hoashi et al. | 367/99 |
| 5,942,688 | A * | 8/1999 | Kimura et al. | 73/598 |
| 5,963,000 | A * | 10/1999 | Tsutsumi et al. | 318/480 |
| 6,080,981 | A | 6/2000 | Payne | |
| 6,344,642 | B1 | 2/2002 | Agam et al. | |
| 6,671,225 | B2 * | 12/2003 | Bartz et al. | 367/89 |
| 6,678,208 | B2 * | 1/2004 | Sifferman et al. | 367/89 |
| 6,678,999 | B2 * | 1/2004 | Zengguang et al. | 49/25 |
| 6,680,688 | B1 * | 1/2004 | Jiang et al. | 342/52 |
| 6,782,660 | B2 * | 8/2004 | Takada et al. | 49/25 |
| 6,970,085 | B2 * | 11/2005 | Okabe et al. | 340/545.6 |
| 7,042,492 | B2 * | 5/2006 | Spinelli | 348/143 |
| 7,045,764 | B2 * | 5/2006 | Beggs et al. | 250/221 |
| 7,064,666 | B2 * | 6/2006 | Sasaki et al. | 340/545.3 |
| 7,123,144 | B2 | 10/2006 | Anderson et al. | |
| 7,154,112 | B2 * | 12/2006 | Eubelen | 250/559.31 |
| 7,495,556 | B2 * | 2/2009 | Eubelen et al. | 340/552 |
| 7,738,192 | B1 * | 6/2010 | Tobey et al. | 359/802 |
| 7,762,022 | B2 * | 7/2010 | Stadler et al. | 49/506 |
| 8,077,034 | B2 * | 12/2011 | Borlez et al. | 340/552 |
| 2001/0030689 | A1 * | 10/2001 | Spinelli | 348/155 |
| 2002/0036259 | A1 | 3/2002 | Agam et al. | |
| 2003/0122514 | A1 | 7/2003 | Mercier et al. | |
| 2005/0103577 | A1 | 5/2005 | Warner | |
| 2006/0162254 | A1 * | 7/2006 | Imai et al. | 49/26 |

FOREIGN PATENT DOCUMENTS

| | | | |
|---|---|---|---|
| EP | 0814178 | A1 | 12/1997 |
| EP | 0897996 | A1 | 2/1999 |
| EP | 1111086 | A1 | 6/2001 |
| FR | 2898377 | | 9/2007 |
| JP | 2001194448 | A | 7/2001 |
| JP | 2002350536 | A | 12/2002 |

OTHER PUBLICATIONS

European Search Report, mailed Jun. 2, 2009.
International Search Report, mailed Feb. 26, 2009.
The translation of the Japanese Office Action mailed Dec. 4, 2012 for Japanese Patent Application No. 2011-510465.
English Translation of Search Report from State Intellectual Property Office fo People's Republic of China.
English Translation of Chinese Office Action, mailed Apr. 3, 2013.
English Translation of Search Report from State Intellectual Property Office fo People's Republic of China. Mar. 22, 2013.

* cited by examiner

DOOR ZONE PROTECTION

BACKGROUND

The present invention relates to monitoring elevator doors and other portals of entry and egress. More particularly, the present invention relates to an apparatus and method for monitoring doors to ensure the safety of those entering and leaving through the doors.

The current method for monitoring elevator doors and the like is to use what is known as a two-dimensional (2D) array of light emitting diode (LED) devices that present a light curtain in the doorway. When a person or object crosses through the light curtain, photodetectors positioned to receive light from the LEDs sense a break in the light curtain, and the device triggers the doors to open. The problem with this method is that it does not give any information about what is about to happen, because it can only determine what is happening in the doorway at any time. U.S. Pat. No. 6,344,642 shows one form of 2D door control.

One solution that has been proposed is to use an additional group of LED devices that are angled outward from the elevator door into the lobby area. The LED devices are arranged so that light is bounced off something and received by a group of photodetectors. If the photodetectors detect a reflection, the system determines that something is on the way to the doorway and opens the doors.

The problem with this solution is that light will reflect off inanimate objects as well as people, generating a false positive or trigger. These false triggers can cause the system to open the doors fully, and then send a new signal when the doors start to close because no one entered through the door. The same inanimate object may cause the false trigger again multiple times. Elevators are programmed to shut down when the doors are reopened more than a predetermined number of times. This requires a service call by a mechanic, and, of course, not only takes the elevator temporarily out of service but increases maintenance costs.

In light of the foregoing, the present invention aims to resolve one or more of the aforementioned issues that can affect conventional elevator doors.

SUMMARY

An embodiment of the present invention addresses an apparatus for detecting an object in an area adjacent a doorway. This apparatus includes, among other possible things, a plurality of transducers mounted proximate the doorway and a processor. At least one of the transducers is positioned to repeatedly transmit signals toward an area adjacent the doorway. At least two of the transducers are positioned to repeatedly receive return signals. The processor is operably connected to the plurality of transducers for detecting, in the area adjacent the doorway, an object by determining the object's: position based upon one or more determined distances derived from times between transmission of signals and reception of corresponding return signals; and/or movement based upon transmission of signals and Doppler shift in the reception of corresponding return signals.

Another embodiment of the present invention addresses an apparatus for controlling operation of an elevator door. This apparatus includes, among other possible things, a plurality of transducers, a processor, and a door controller. The plurality of transducers are mounted proximate an elevator doorway for repeatedly transmitting signals toward an area adjacent the elevator doorway and receiving corresponding return signals. The processor is for detecting, in the area adjacent the elevator doorway, an object by determining the object's: position based upon one or more determined distances derived from times between transmission of the signals and reception of corresponding return signals; and/or movement based upon transmission of signals and Doppler shift in the reception of corresponding return signals. The processor is configured to produce an output based on the object's determined position and/or movement. The door controller is for controlling operation of the elevator door as a function of the output of the processor.

Another embodiment of the present invention addresses a method for detecting an object in an area adjacent a doorway. This method includes, among other possible steps, providing a plurality of transducers mounted proximate the doorway; activating at least one of the transducers to transmit a signal toward an area adjacent the doorway; receiving a return signal at the transmitting transducer and/or at one or more of the other of the plurality of transducers; deriving a determined distance for each receiving transducer based upon a time between transmission of the signal by the transmitting transducer and reception of the return signal by that transmitting transducer and/or by the one or more of the other of the plurality of transducers; and detecting an object based upon at least one of the determined distances.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
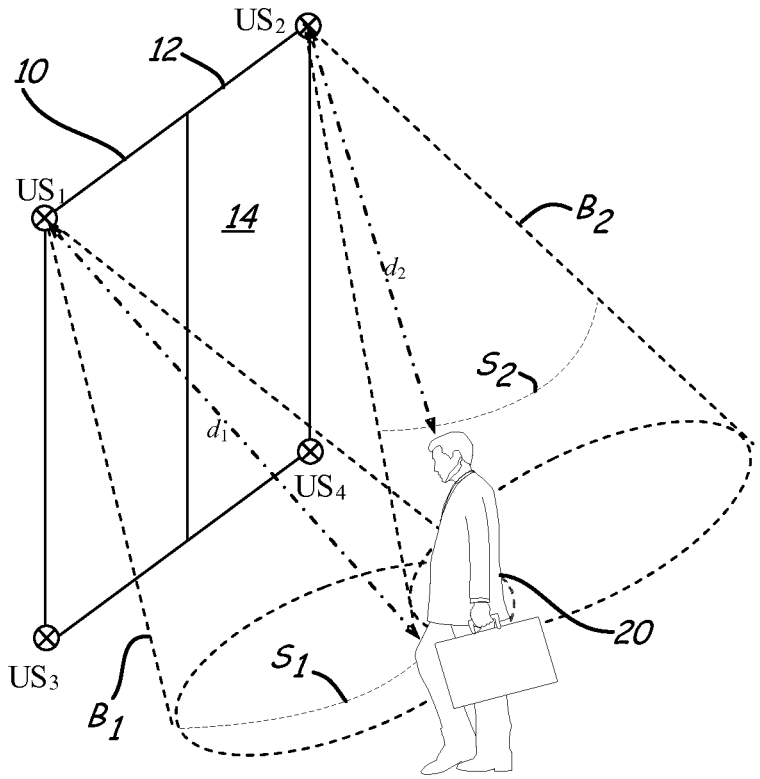
FIG. 1 is a schematic view of an embodiment of the present invention, showing a plurality of transducers detecting the approach of an individual toward an elevator door.

Efforts have been made throughout the drawings to use the same or similar reference numerals for the same or like components.

Throughout this application the term 'transducer' is typically used to refer to a signal device that includes both a transmitter and a receiver. Of course, however, separate transmitters and receivers can be paired to achieve the same technical result and, therefore, the term 'transducer' is to be interpreted to cover both a single device that contains a transmitter and a receiver as well as a separate transmitter and receiver pair.

In FIG. 1, four transducers $US_1$, $US_2$, $US_3$, and $US_4$ are positioned around elevator doorway 10. Transducers $US_1$-$US_4$, which in the hereafter described embodiment are ultrasonic transducers but could, of course, be other types of signal transducers (such as microwave, infrared, etc.), may be mounted on or adjacent doorframe 12 of doorway 10, or on doors 14. Transducers $US_1$-$US_4$ are spaced from one another, and each is oriented to transmit ultrasonic signals (also referred to as pulses) outward from doorway 10 toward the hallway or lobby area in front of doorway 10. Depending upon the size of the elevator and the area of the adjacent lobby, more transducers or fewer may transmit signals to ensure the entire area of interest is surveyed.

In facilities with large lobbies or areas proximate the door and transducers, a cut-off distance can be incorporated into the processor so that the system does not respond to movement too far to be needed. For example, objects at or beyond a set cut-off distance away may not be of interest. This variable is hardware or software adjustable, depending upon the size of the lobby, the volume of traffic, and other factors. For such objects at or beyond the cut-off distance, signals that are reflected by such objects may be disregarded as irrelevant. The distance of such distant objects would be determined by the elapsed travel time of the signal.

Each ultrasonic transducer $US_i$ (where i=1, 2, 3, 4, in the example shown in FIG. 1) sends a sound pulse in the form of a conical beam $B_i$ at time $t_i$ from the measured time until a return pulse is received, the distance ($d_i$, i=1, 2, 3, 4) to the closest object 20 can be determined. Such an object may be, for example, one or more persons, animals, strollers, luggage, or other object. Each ultrasonic transducer $US_i$ periodically repeats this procedure in a time period, such as, every p milliseconds. The number p may depend on the door dimension, the size of the lobby, the detection distance capability needed, and also may take into account the speed of the sound. From the distance measurements $d_i$ in time periods $t_i$, $t_i$+p, $t_i$+2p, . . . , it is possible to determine how fast, and in what direction, an object is moving in front of elevator doorway 10.

When a plurality of doorways are fitted with the present invention, such as when a number of elevator doors are next to or across from each other, particular frequencies or groups of frequencies can be used by each doorway to eliminate crosstalk between the multiple doorways. In other words, each doorway will emit and receive a particular frequency or group of frequencies so that if another frequency (or a frequency that is not in a particular doorway's set of frequencies) is received, such frequency can be disregarded as pertaining to a signal emitted by another doorway.

To avoid scenarios when it is impossible to determine the origin of the sound reflected by the object, time division multiplexing can be used. Namely, if several transducers send ultrasonic pulses toward an object at the same time and then these transducers receive the reflected return pulses back from the object, an individual transducer cannot determine whether the return pulse originated from that transducer or another transducer. With time division multiplexing, each transducer sends its ultrasonic pulse during a different time period (also referred to as a time interval) than the other transducers. The intervals are long enough to allow an ultrasonic pulse to be transmitted and a return pulse received before the next transducer in the sequence is activated. Alternatively, transducers $US_i$ could transmit at different ultrasonic frequencies (i.e., frequency multiplexing), in which case they could operate simultaneously or in overlapping time periods.

It is also contemplated that each transducer can transmit at its own unique frequency and receive reflected pulses at all frequencies. This would permit use of twice the information per signature frequency, and would enable the system to use two transducers, each of which processes its own unique frequency as well as the unique frequency of the other transducer. This embodiment would operate by sequentially transmitting from each transmitter selected and having some or all of the receivers listening for the signals.

FIG. 1 shows an example in which one person 20 is standing or moving in the lobby area in front of doorway 10. Beams $B_1$ and $B_2$ transmitted by transducers $US_1$ and $US_2$, respectively, are illustrated in FIG. 1. Beams $B_1$ and $B_2$ may be transmitted either sequentially (using time division multiplexing) or simultaneously (using frequency multiplexing), along with beams (not shown) from transducers $US_3$ and $US_4$.

Those parts of person 20 that are in the path of beam B1 will reflect ultrasonic energy back to transducer US1. Because not all portions of the body of person 20 may be the same distance from transducer US1, the time of flight may be based upon when the return pulse leading edge reception begins (e.g., by being reflected by the part of the person closest to the transducer), at a later time (e.g., by being reflected by the part of the person farthest from the transducer), or on an average time. Regardless, the distance determined by the time of flight can, for example through software, be used to construct a 2D image of a person 20.

In FIG. 1, a detected distance $d_1$ from $US_1$ to person 20 is illustrated. Based upon the detected distance $d_1$, a spherical surface $S_1$ can be derived, with the location of $US_1$ as the center of the sphere and $d_1$ as its radius.

FIG. 1 also shows beam $B_2$ from $US_2$, and the corresponding detected distance $d_2$ and spherical surface $S_2$. Similar detected distances and spherical surfaces are produced based upon time of flight of ultrasonic pulse beams from transducers $US_3$ and $US_4$.

Based upon the detected distances and knowledge of the normal layout of the lobby or hallway, the presence of an object, such as person 20, can be detected. If the lobby normally does not have objects located at the distance $d_i$ produced by one or more of transducers $US_i$, the presence of an object in front of doorway 10 can be assumed.

By using the detected distance $d_i$ collected over a sequence of ultrasonic pulses from the same transducer $US_i$, motion of person 20 can be detected. For example, if distances $d_i$ from several transducers $US_i$ are decreasing over time, this indicates that person 20 is moving toward doorway 10. Conversely, if several of distances $d_i$ are increasing over time, it indicates person 20 is moving away from doorway 10. It is also possible to determine that person 20 is passing doorway 10 based upon some detected distances increasing while others are decreasing.

Using the spherical surfaces $S_i$, it is possible to determine a location and movement of person 20. If some or all of the spherical surfaces intersect, the coordinates of the intersections provide a location of person 20 in three-dimensional space. Changes in that location over time can be used to determine motion and to predict whether person 20 intends to enter the elevator. If the spherical surfaces do not intersect, but multiple distances $d_i$ indicate a detected presence, this may be interpreted as having more than one person in the hallway or lobby.

Figure 2:
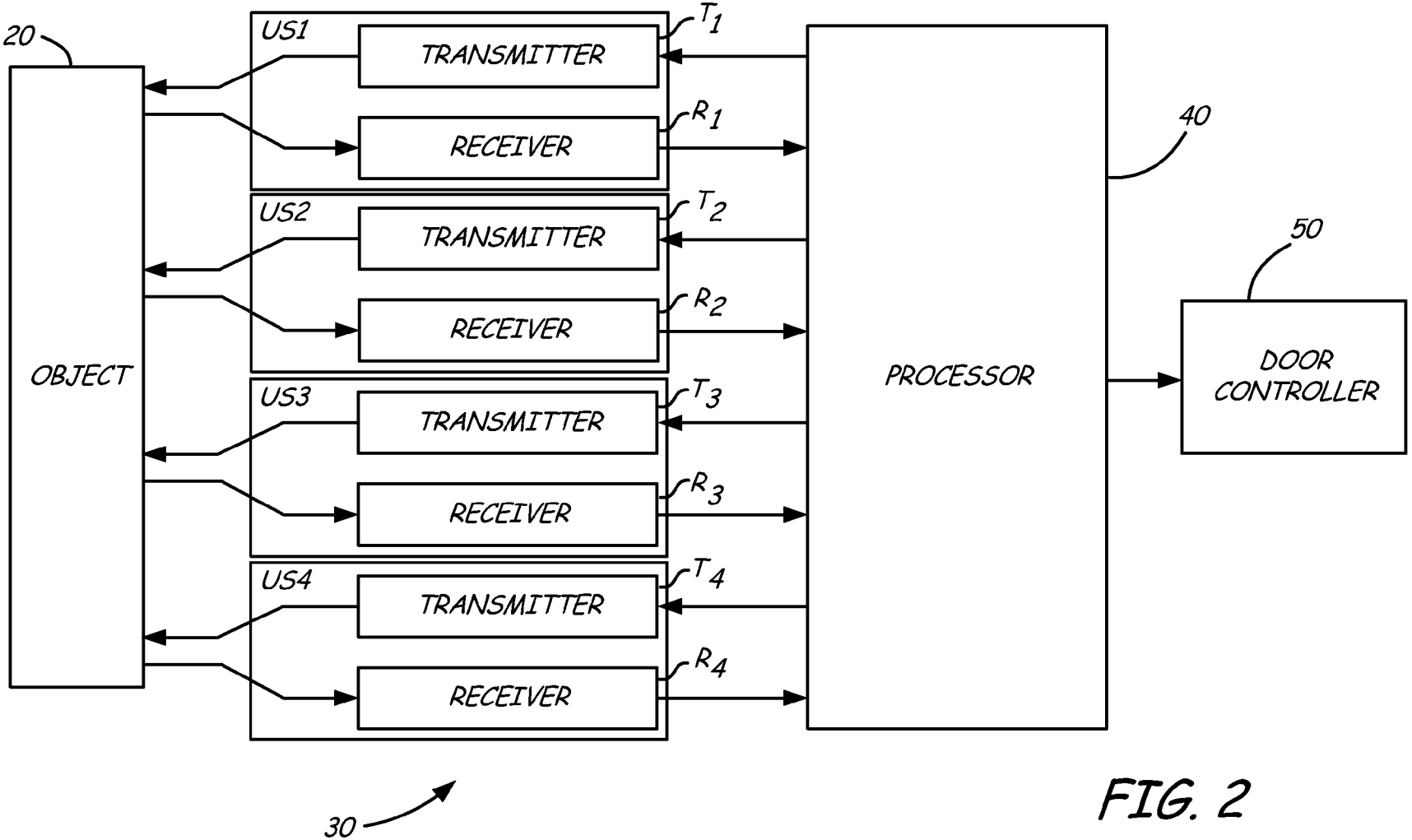
FIG. 2 is a block diagram illustrating the operation of the embodiment of the present invention shown in FIG. 1.

FIG. 2 is a block diagram of control system 20, which uses ultrasonic detection to control operation of elevator doors 14 of FIG. 1. Control system 30 includes ultrasonic transducers $US_i$-$US_4$, transmitter circuits $T_1$-$T_4$, receiver circuits $R_1$-$R_4$, processor 40, and door controller 50. As shown in FIG. 2, each ultrasonic transducer $US_1$-$US_4$ has an associated transmitter circuit $T_1$-$T_4$ and an associated receiver circuit $R_1$-$R_4$, respectively.

Processor 40 controls when the ultrasonic pulses from transducers $US_1$, $US_2$, $US_3$, and $US_4$ are generated by controlling transmitters $T_1$-$T_4$, respectively. When a transmitter (e.g., transmitter $T_1$) receives a command from processor 40, it generates an electrical drive signal at a frequency that will cause the transducer (e.g., $US_1$) to generate an ultrasonic pulse. When the reflected pulse is received by the associated receiver $R_1$-$R_4$ (e.g., receiver $R_1$), a received signal is then sent to the processor 40. Processor 40 measures the time of flight from when the ultrasonic signal is initially emitted by the transmitter $T_1$-$T_4$ (e.g., transmitter $T_1$) until the reflected ultrasonic pulse is received by the associated receiver $R_1$-$R_4$ (e.g., receiver $R_1$). Based upon the time of flight from transmission to receipt processor 40 calculates distance $d_i$. From the detected distances, processor 40 can use triangulation to determine whether an object is present, and where the object is located. Further, by detecting changes in an object's position over time, the processor 40 can determine whether the object is moving toward or away from the doors or is stationary.

In combination with the time of flight of the received pulses, the same signal can be processed by the processor for Doppler shift. This Doppler processing, which can occur before, after, or simultaneously with the time of flight triangulation, provides direction to or from the doorway, and the speed of the object, but does not provide the position of the object (which is determined using the time of flight triangulation). As a result of the combination of the Doppler shift processing and the time of flight triangulation processing, all of the location, speed, and direction of an object can be determined.

The output of the processor 40 is an input to door controller 50 which operates doors 14 of the elevator. For example, if the output of the processor 40 indicates that an object is moving toward the doors 14, the door controller 50 can instruct the doors 14 to open (or to remain open). Similarly, if a detected object is moving away from the doors 14, the output from the processor 40 can instruct the door controller 50 to continue closing the doors 14.

Figure 3:
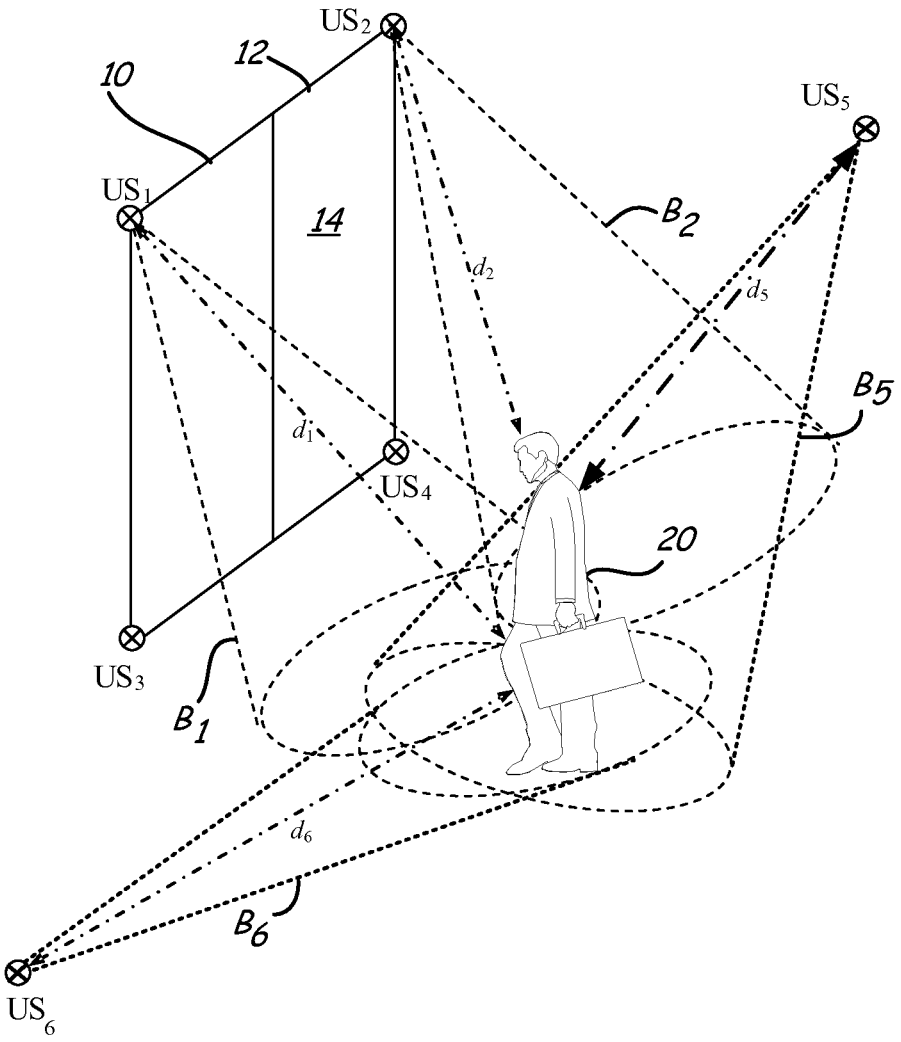
FIG. 3 is a schematic view of another embodiment of the present invention, showing an additional set of transducers for determining a 3D image detection.

FIG. 3 illustrates the addition of transducers $US_5$ and $US_6$ that are similar to the transducers of FIG. 1, but have been placed in a different plane and transmit beams $B_5$ and $B_6$ to determine the depth or third dimension of the object of interest. These transducers $US_5$ and $US_6$ can be mounted on the wall, the ceiling, or other parts of the lobby. The processor would add their data to give the 3D information.

The aforementioned discussion is intended to be merely illustrative of the present invention and should not be construed as limiting the appended claims to any particular embodiment or group of embodiments. Thus, while the present invention has been described in particular detail with reference to a specific exemplary embodiment thereof, it should also be appreciated that numerous modifications and changes may be made thereto without departing from the broader and intended scope of the invention as set forth in the claims that follow.

The specification and drawings are accordingly to be regarded in an illustrative manner and are not intended to limit the scope of the appended claims. In light of the foregoing disclosure of the present invention, one versed in the art would appreciate that there may be other embodiments and modifications within the scope of the present invention. Accordingly, all modifications attainable by one versed in the art from the present disclosure within the scope of the present invention are to be included as further embodiments of the present invention. The scope of the present invention is to be defined as set forth in the following claims.

The invention claimed is:

1. Apparatus for detecting an object in an area adjacent a doorway, the apparatus comprising:

a plurality of transducers mounted proximate the doorway, wherein at least two of the transducers are positioned to repeatedly transmit signals toward an area adjacent the doorway, and wherein at least two of the transducers are positioned to repeatedly receive return signals from a transmitting transducer; and a processor operably connected to the plurality of transducers for detecting, in the area adjacent the doorway, an object by determining the object's position and the object's movement, wherein the processor is configured to measure times of flight between transmission of signals and reception of corresponding return signals and to calculate a corresponding determined distance from the corresponding transducer to the object based on a corresponding time of flight and to derive a corresponding spherical surface with a location of a corresponding transceiver as a center of the spherical surface and the corresponding determined distance as a radius of the spherical surface and to determine the object's position by determining coordinates of an intersection of at least two corresponding spherical surfaces;

wherein the processor is configured to determine the object's movement based upon transmission of signals and Doppler shift in the reception of corresponding return signals.

2. The apparatus of claim 1, wherein the plurality of transducers comprises three or more transducers.

3. The apparatus of claim 1, wherein each of the plurality of transducers is configured to transmit a signal at a respectively unique frequency and is configured to receive reflected signals substantially only at its unique frequency.

4. The apparatus of claim 3, wherein each of the unique frequencies is ultrasonic.

5. The apparatus of claim 1, wherein each of the plurality of transducers is configured to transmit a signal at a respectively unique frequency and is configured to receive reflected signals of all frequencies.

6. The apparatus of claim 5, wherein each of the unique frequencies is ultrasonic.

7. The apparatus of claim 1, wherein each of the plurality of transducers is configured to repeatedly transmit and receive signals during a respectively unique time period.

8. The apparatus of claim 7, wherein each of the signals is an ultrasonic signal.

9. The apparatus of claim 1, wherein the processor provides an output for controlling operation of a door associated with the doorway.

10. The apparatus of claim 1, wherein the processor is configured to determine a movement of the object relative to the area adjacent the doorway based upon changes in at least one of the determined distances over time.

11. The apparatus of claim 1, wherein the processor is configured to determine a location of the object within the area adjacent the doorway based upon at least two of the determined distances.

12. The apparatus of claim 1, wherein the processor is configured to process the signals for Doppler shift to provide direction and speed of the object.

13. The apparatus of claim 12, wherein the processor is configured to process the Doppler shift after processing the time between transmissions of signals and receptions of return signals.

14. Apparatus for controlling operation of an elevator door, the apparatus comprising;

a plurality of transducers mounted proximate an elevator doorway for repeatedly transmitting signals toward an area adjacent the elevator doorway and receiving corresponding return signals;

a processor for detecting, in the area adjacent the elevator doorway, an object, by determining the object's position and the object's movement, wherein the processor is configured to measure times of flight between transmission of the signals and reception of corresponding return signals and to calculate a corresponding determined distance from a corresponding transducer to the object based on a corresponding time of flight and to derive a corresponding spherical surface with a location of the corresponding transceiver as a center of the spherical surface and the corresponding determined distance as a radius of spherical surface and to determine the object's position by determining coordinates of intersection of at least two corresponding spherical surfaces;

wherein the processor is configured to determine the object's movement based upon transmission of signals and Doppler shift in the reception of corresponding return signals, and wherein the processor is configured to produce an output based on the object's determined position and movement; and wherein a cut-off distance is incorporated into the processor and a signal that is reflected by the object at or beyond the cut-off distance is disregarded as irrelevant; and a door controller for controlling operation of the elevator door as a function of the output of the processor.

15. The apparatus of claim 14, wherein the plurality of transducers comprises three or more transducers.

16. The apparatus of claim 14, wherein each of the plurality of transducers is configured to transmit signals at a respectively unique frequency.

17. The apparatus of claim 16, wherein each of the unique frequencies is ultrasonic.

18. The apparatus of claim 14, wherein each of the plurality of transducers is configured to transmit and receive signals during a respectively unique time period.

19. The apparatus of claim 18, wherein each of the signals is an ultrasonic signal.

20. The apparatus of claim 14, wherein the processor is configured to determine a direction of movement of the object.

21. The apparatus of claim 14, wherein the processor is configured to process the signals for Doppler shift to provide direction and speed of the object.

22. The apparatus of claim 21, wherein the processor is configured to process the Doppler shift after processing the time between transmissions of signals and receptions of return signals.

* * * * *